US006230797B1

(12) United States Patent
Collins

(10) Patent No.: US 6,230,797 B1
(45) Date of Patent: May 15, 2001

(54) FLOW CONTROL DEVICE RETRIEVAL TOOL AND METHOD

(75) Inventor: Leo G. Collins, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/353,903

(22) Filed: Jul. 16, 1999

(51) Int. Cl.[7] ..... E21B 31/12

(52) U.S. Cl. ..... 166/98; 166/301; 294/86.16; 294/86.17

(58) Field of Search ..... 166/98, 237, 301; 294/86.16, 86.17, 86.18

(56) References Cited

U.S. PATENT DOCUMENTS 2,984,302 * 5/1961 Churchj ..... 166/98
4,715,445 * 12/1987 Smith, Jr. ..... 166/377
4,883,120 * 11/1989 Schasteen et al. ..... 166/98
5,398,753 * 3/1995 Obrejanu et al. ..... 166/98
5,765,638 * 6/1998 Taylor ..... 166/98
5,947,202 * 9/1999 Gazewood ..... 166/301

* cited by examiner

*Primary Examiner*—David Bagnell
*Assistant Examiner*—Jennifer R. Dougherty
(74) *Attorney, Agent, or Firm*—Paul I. Herman; Marlin R. Smith

(57) ABSTRACT

A retrieval tool provides enhanced functionality for retrieving an item of equipment from within a tubular string in a subterranean well. In a described embodiment, a retrieval tool includes an anchoring device. The anchoring device releasably secures the retrieval tool in the tubular string relative to the item of equipment to be retrieved. An actuator of the retrieval tool may then displace a latching mechanism relative to the anchoring device, thereby displacing the item of equipment relative to the tubular string. The latching device may latchingly engage the item of equipment in response to displacement of the latching mechanism by the actuator.

18 Claims, 12 Drawing Sheets

FLOW CONTROL DEVICE RETRIEVAL TOOL AND METHOD

BACKGROUND OF THE INVENTION

The present invention relates generally to operations performed in conjunction with subterranean wells and, in an embodiment described herein, more particularly provides a tool for retrieving items of equipment from within tubular strings in subterranean wells.

It is common for items of equipment to be releasably secured within tubular strings in subterranean wells. For example, a flow control device, such as a safety valve, may be releasably secured in a tubing string by means of a lock mandrel attached thereto. The lock mandrel typically includes an anchoring mechanism, which prevents displacement of the mandrel relative to the tubing string, and at least one seal, which engages a seal bore of the tubing string.

Over time, it may become very difficult to release the lock mandrel from its engagement with the tubing string in order to retrieve the lock mandrel and safety valve for service, replacement, etc. Often, the lock mandrel is difficult to displace relative to the tubing string due to the seal adhering to the seal bore. Thus, it is sometimes necessary to apply a very large amount of force to the lock mandrel to get it free from the tubing string. This may be accomplished by, for example, using jars to repetitively apply an impact to the lock mandrel. However, where the lock mandrel and/or safety valve are relatively heavy, where it is desired to prevent damage to the lock mandrel from impact, or where the lock mandrel is very stuck in the tubing string, it may not be desirable or effective to use the jarring method to retrieve the lock mandrel and safety valve.

Therefore, it may be seen that it would be very desirable to provide another method for retrieving an item of equipment from within a tubular string in a subterranean well. It is accordingly an object of the present invention to provide such a method and an associated retrieval tool.

SUMMARY OF THE INVENTION

In carrying out the principles of the present invention, in accordance with an embodiment thereof, a retrieval tool is provided which solves the problem of retrieving items of equipment from within tubular strings in subterranean wells. The retrieval tool does not require any jarring or any excessive force to be applied thereto in order to retrieve heavy or stuck items of equipment. Associated methods of retrieving items of equipment are also provided.

In one aspect of the present invention, a retrieval tool is provided which includes an actuator for applying a controlled force to the item of equipment. The retrieval tool also includes an anchoring device and a latching mechanism. The anchoring device releasably secures the retrieval tool in a tubing string relative to the item of equipment. The latching mechanism latches the retrieval tool to the item of equipment. The actuator displaces at least a portion of the latching mechanism relative to the anchoring device to thereby displace the item of equipment relative to the tubing string.

In another aspect of the present invention, a retrieval tool is provided which includes a releasing device. The releasing device is configured to release an item of equipment from securement to a tubular string. For example, the item of equipment may include a portion thereof which maintains the item of equipment secured in position in a tubing string. The releasing device displaces the item of equipment portion, thereby permitting release of the item of equipment from the tubing string.

Various methods are provided for accomplishing the release of the item of equipment from securement to the tubing string. In one embodiment, the releasing device displaces the item of equipment portion when the retrieval tool is inserted into the item of equipment. In another embodiment, the releasing device is included in a latching mechanism of the retrieval tool, such that the item of equipment is released for displacement relative to the tubing string when at least a portion of the latching mechanism is displaced to latch the retrieval tool to the item of equipment.

In yet another aspect of the present invention, a method of retrieving an item of equipment from within a tubular string is provided by the present invention. The method includes the steps of conveying a retrieval tool into the tubular string, anchoring the retrieval tool within the tubular string, latching the retrieval tool to the item of equipment and displacing at least a portion of a latching mechanism of the retrieval tool relative to an anchoring device of the retrieval tool. An actuator may be included in the retrieval tool for displacing the latching mechanism in the method.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
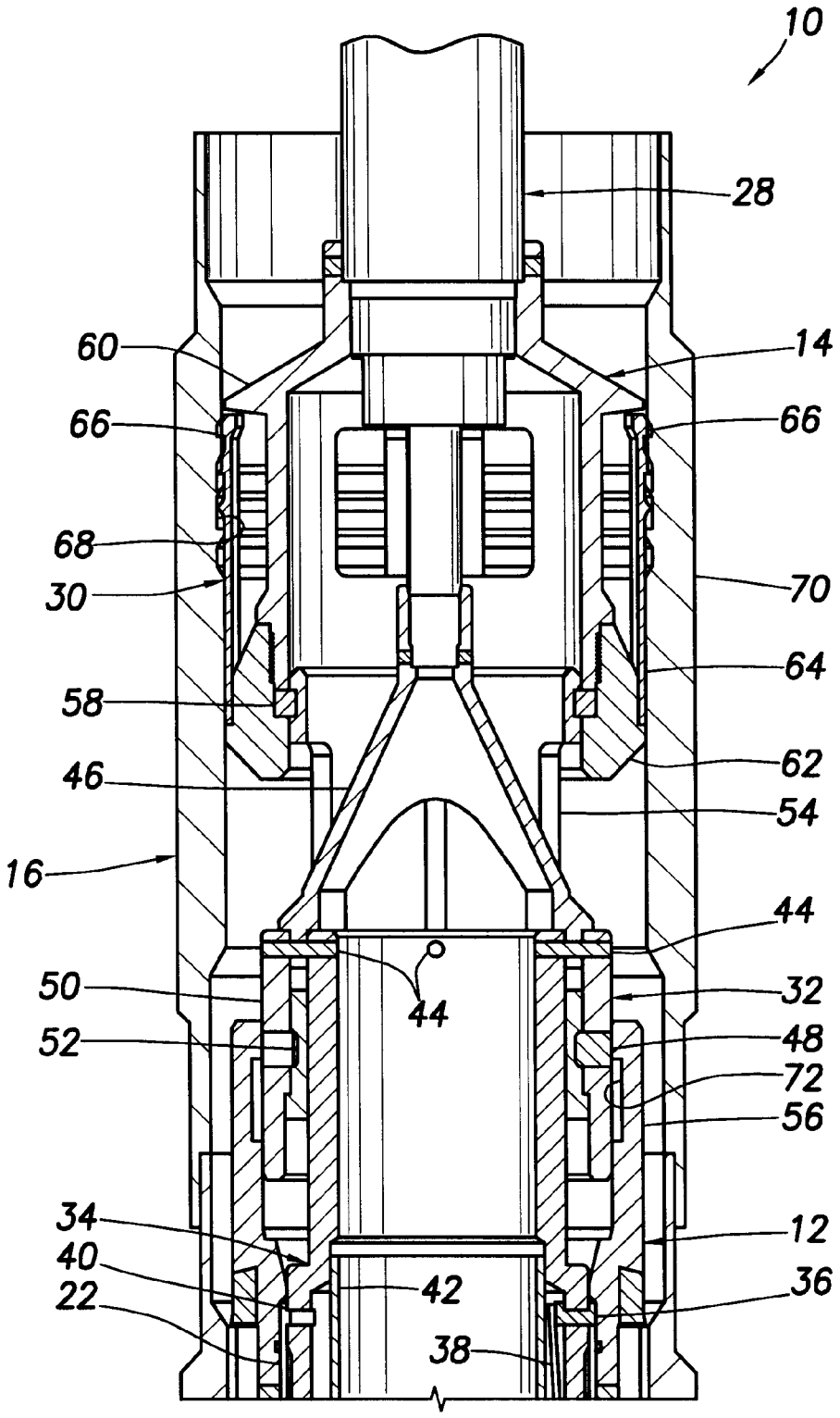
FIGS. 1A&B are cross-sectional views through a first retrieval tool embodying principles of the present invention, the tool being shown in a configuration in which it is conveyed into engagement with a lock mandrel for a flow control device.

Representatively illustrated in FIGS. 1A&B is a method 10 of retrieving an item of equipment 12 which method embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10 as described herein, a retrieval tool 14 is used to retrieve the item of equipment 12 from within a tubing string 16 to which the item of equipment is releasably secured. The item of equipment 12 is representatively a lock mandrel, also known as a locating and locking mandrel, which may be attached to a safety valve (not shown) as described in a copending patent application entitled LOCATING AND LOCKING MANDREL FOR FLOW CONTROL DEVICE, having Leo G. Collins as an inventor thereof, U.S. application Ser. No. 09/353,722, filed Jul. 14, 1999. The disclosure of the copending application is incorporated herein by this reference. However, it is to be clearly understood that the method 10 may be used to retrieve other items of equipment and other types of equipment, and the retrieval tool 14 may be used in other methods, without departing from the principles of the present invention.

Figure 1B:
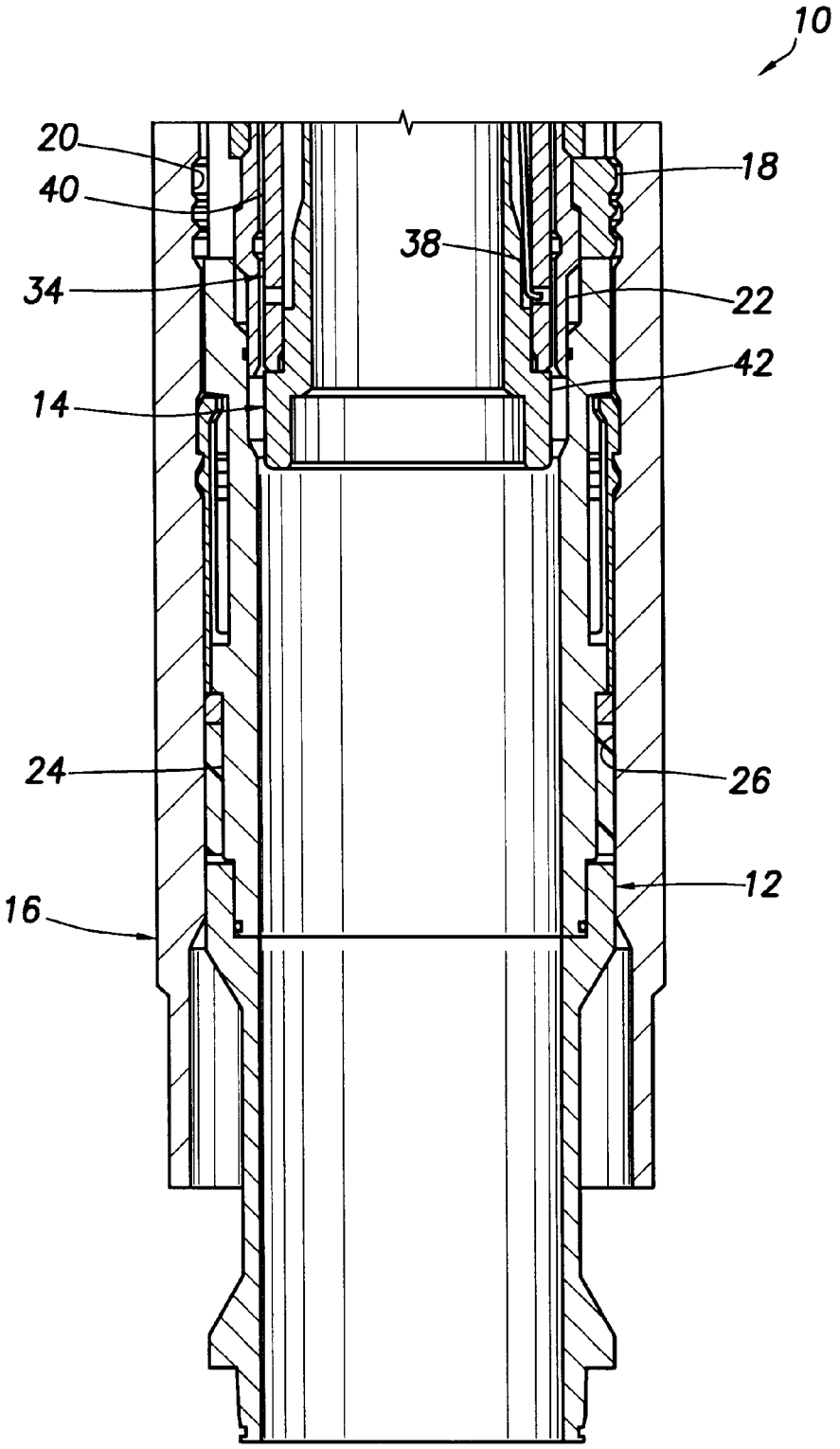

The mandrel 12 includes one or more keys 18 (only one of which is visible in FIG. 1B), which is engaged with an internal profile 20 of the tubing string 16. Such engagement between the key 18 and the profile 20 releasably secures the mandrel 12 relative to the tubing string 16. The key 18 is maintained in engagement with the profile 20 by a locking sleeve 22 which radially outwardly supports the key. Thus, in order to release the mandrel 12 from its securement to the tubing string 16, the sleeve 22 must be displaced so that it no longer maintains the key 18 in engagement with the profile 20.

The mandrel 12 also includes a seal 24 sealingly engaged with a seal bore 26 formed in the tubing string 16. Over time, the seal 24 may become adhered to the seal bore 26, or it may otherwise become difficult to remove the seal from the seal bore. Therefore, it is desirable for the retrieval tool 14 to apply a large, controlled force to the mandrel 12 after the key 18 is released from its engagement with the profile 20, in order to displace the mandrel relative to the tubing string 16. Of course, there may be other reasons, such as debris collected about the mandrel 12, etc., for applying the large, controlled force to the mandrel to displace it relative to the tubing string 16.

The retrieval tool 14 includes an actuator 28, an anchoring device 30, a latching mechanism 32 and a releasing device 34. The releasing device 34 includes multiple release members or dogs 36 (only one of which is visible in FIG. 1A), each of which is radially outwardly biased by a spring 38. The dog 36 extends radially outward through a sidewall of an outer tubular housing 40. The spring 38 is retained between the outer housing 40 and an inner tubular housing 42. The inner and outer housings 40, 42 are threadedly attached to each other at the bottom end of the releasing device 34, and the outer housing 40 is attached to the actuator 28 and the latching mechanism 32 by one or more shear members 44, although in normal operation the outer housing is not released by shearing the shear members.

The actuator 28 may be any actuator capable of applying a force to the latching mechanism 32, and displacing the latching mechanism relative to the anchoring device 30. The representatively illustrated actuator 28 is a conventional Downhole Power Unit (DPU) available from Halliburton Energy Services, Inc. The DPU is typically conveyed on slickline and operates on battery power. However, it is to be clearly understood that other actuators, and other types of actuators, may be used in the retrieval tool 14, without departing from the principles of the present invention. For example, the actuator 28 may instead be conveyed on coiled tubing, segmented tubing, electric line, wireline, etc., and the actuator may be hydraulically, mechanically, chemically, electrically, or otherwise operated.

The actuator 28 is connected to the latching mechanism 32 by an adapter 46. Of course, if an actuator other than the DPU is used in the tool 14, the adapter 46 may accordingly have a different configuration. The adapter 46 is releasably secured to the latching mechanism 32 and the releasing device 34 by the shear members 44.

The latching mechanism 32 includes multiple lugs 48 (only one of which is visible in FIG. 1A), which are radially outwardly extendable through a sidewall of an outer sleeve 50. Note that, as shown in FIG. 1A, the lug 48 is received in an annular recess 52 formed externally on a tubular extension 54. In this configuration, the lug 48 is in its radially retracted position, permitting it to enter into an upper head or fishing neck 56 of the mandrel 12. The extension 54 is attached to the anchoring device 30 by means of a split ring or C-ring 58.

The anchoring device 30 includes upper and lower housings 60, 62, respectively. The housings 60, 62 are threaded to each other, thereby capturing the C-ring 58 therebetween and attaching the extension 54 to the anchoring device 30. The threaded engagement between the housings 60, 62 also retains a colletted member 64 axially therebetween. The colletted member 64 has multiple resilient collets 66 formed thereon, which are complementarily shaped relative to an annular profile 68 formed internally on a tubular nipple 70 interconnected in the tubing string 16.

Engagement between the collets 66 and the profile 68 is used to position the retrieval tool 14 relative to the mandrel 12 and resist a force applied by the actuator 28 to the mandrel, as described in more detail below. However, it is to be clearly understood that other means of anchoring the retrieval tool 14 relative to the tubing string 16 may be utilized, without departing from the principles of the present invention. For example, the anchoring device 30 could include one or more slips, of the type used on packers, hangers, etc., which could be grippingly engaged with the interior of the tubing string 16. Therefore, it is not necessary for the anchoring device 30 to include the collets 66, or for the tubing string 16 to include the profile 68.

As depicted in FIG. 1A, the retrieval tool 14 has not yet displaced downward far enough for the collets 66 to engage the profile 68, and so it appears that an interference fit is experienced between the collets and the nipple 70. In actual practice, the collets 66 are bowed inward when such a potential interference fit is experienced, thereby permitting the anchoring device 30 to pass through such restrictions. However, when the collets 66 displace downward sufficiently for the collets to align with the profile 68, they will spring outward into engagement with the profile and prevent further downward displacement of the retrieval tool 30.

The method 10 is representatively depicted in FIG. 1A as the retrieval tool 14 is being inserted into the mandrel 12. At this point, the dogs 36 of the releasing device 34 have engaged the top of the locking sleeve 22. Further downward displacement of the retrieval tool 14 will, thus, cause the locking sleeve 22 to be displaced downwardly therewith, thereby permitting the keys 18 to disengage from the profile 20.

Figure 2A:
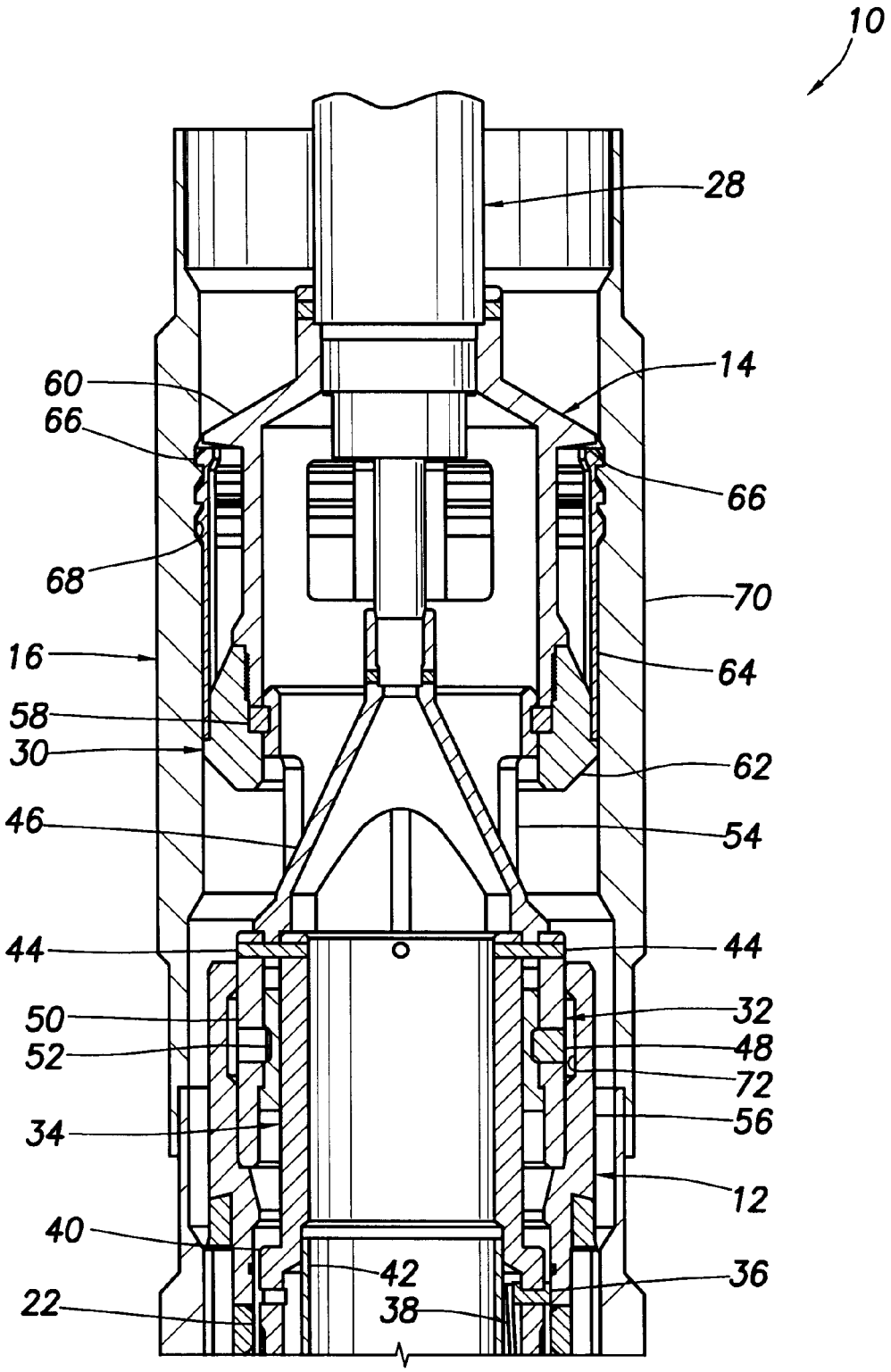
FIGS. 2A&B are cross-sectional views of the retrieval tool of FIG. 1, the tool being shown in a configuration in which it is engaged with a nipple interconnected in a tubular string above the mandrel and has released the mandrel for displacement relative to the tubular string.
Figure 2B:
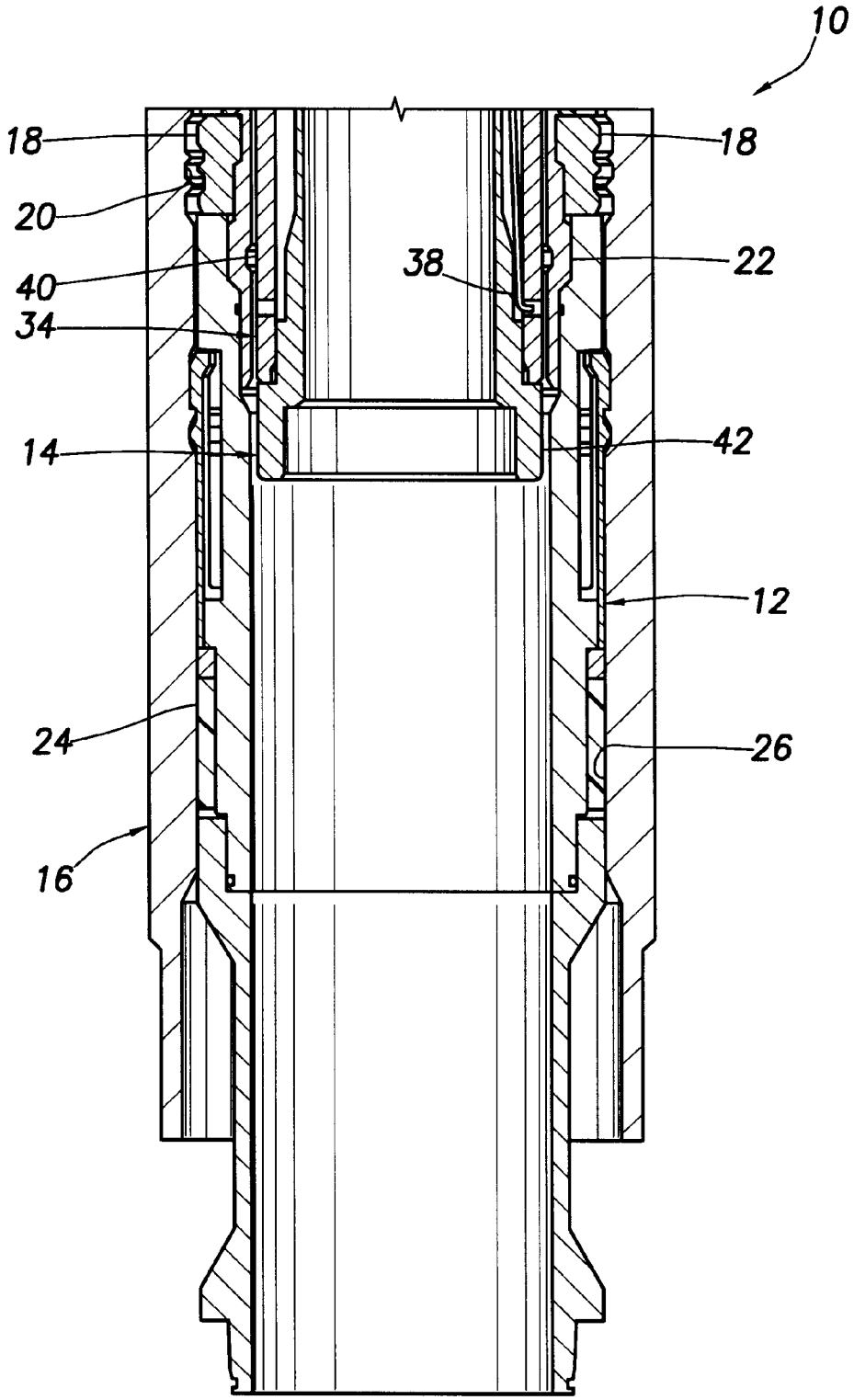

Referring additionally now to FIGS. 2A&B, the retrieval tool 14 is depicted in a configuration in which it has been downwardly displaced sufficiently far for the collets 66 to engage the profile 68 and, therefore, the tool is prevented from displacing further downward. Note, also, that downward displacement of the tool 14 has caused the dogs 36 to displace the locking sleeve 22 downward, so that the sleeve no longer radially outwardly supports the keys 18 in engagement with the profile 20. Thus, the mandrel 12 is now released for displacement relative to the tubing string 16. However, note that the seal 24 remains engaged within the seal bore 26 and may hinder retrieval of the mandrel 12 from the tubing string 16.

Figure 3A:
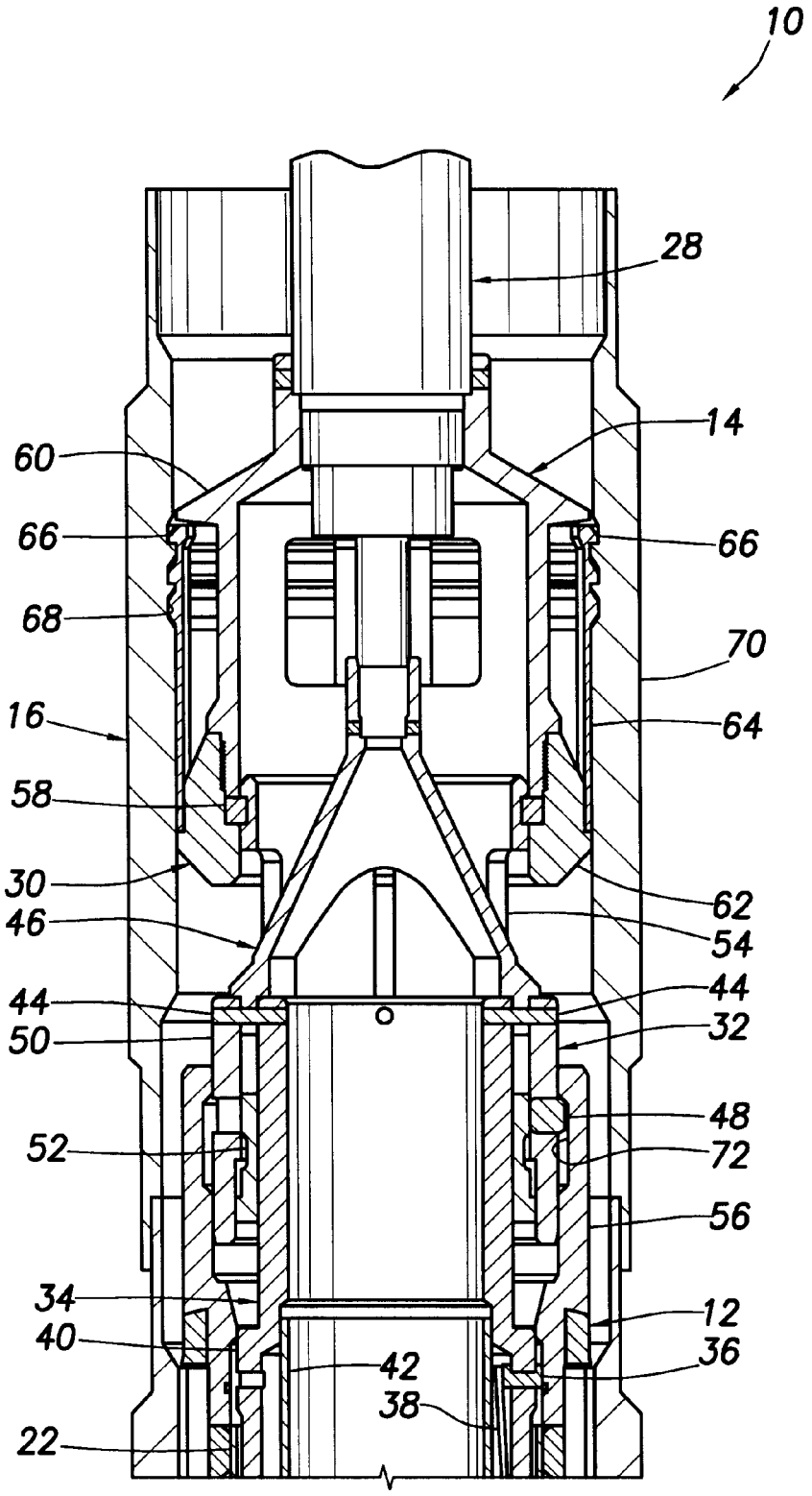
FIGS. 3A&B are cross-sectional views of the retrieval tool of FIG. 1, the tool being shown in a configuration in which it has latchingly engaged the mandrel.
Figure 3B:
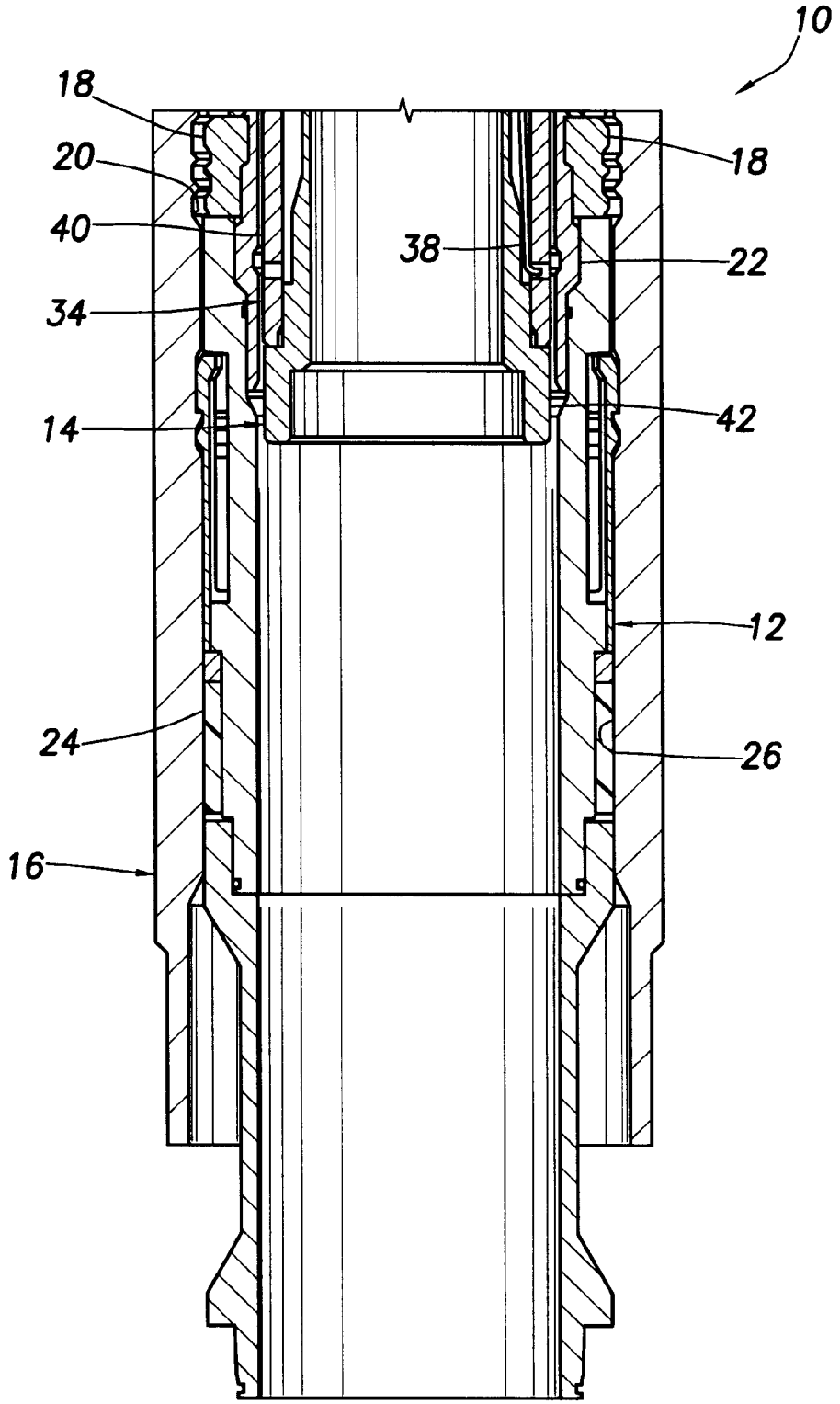

Referring additionally now to FIGS. 3A&B, the retrieval tool 14 is depicted in a configuration in which it is latchingly engaged with the is mandrel 12, so that an upward force may be applied to the mandrel to free it from the tubing string 16. The actuator 28 has been operated to displace the sleeve 50 and lugs 48 upward, while the extension 54 remains anchored relative to the tubing string 16. Such upward displacement of the sleeve 50 and lugs 48 causes the lugs to displace radially outward out of the recess 52. Thus, the extension 54 now radially outwardly supports the lugs 48 in engagement with an internal annular profile 72 formed in the fishing neck 56. Note that the releasing device 34 is displaced upwardly by the actuator 28 along with the sleeve 50 and the lugs 48, but displacement of the releasing device has no effect at this time, since the keys 18 remain disengaged from the profile 20.

Figure 4A:
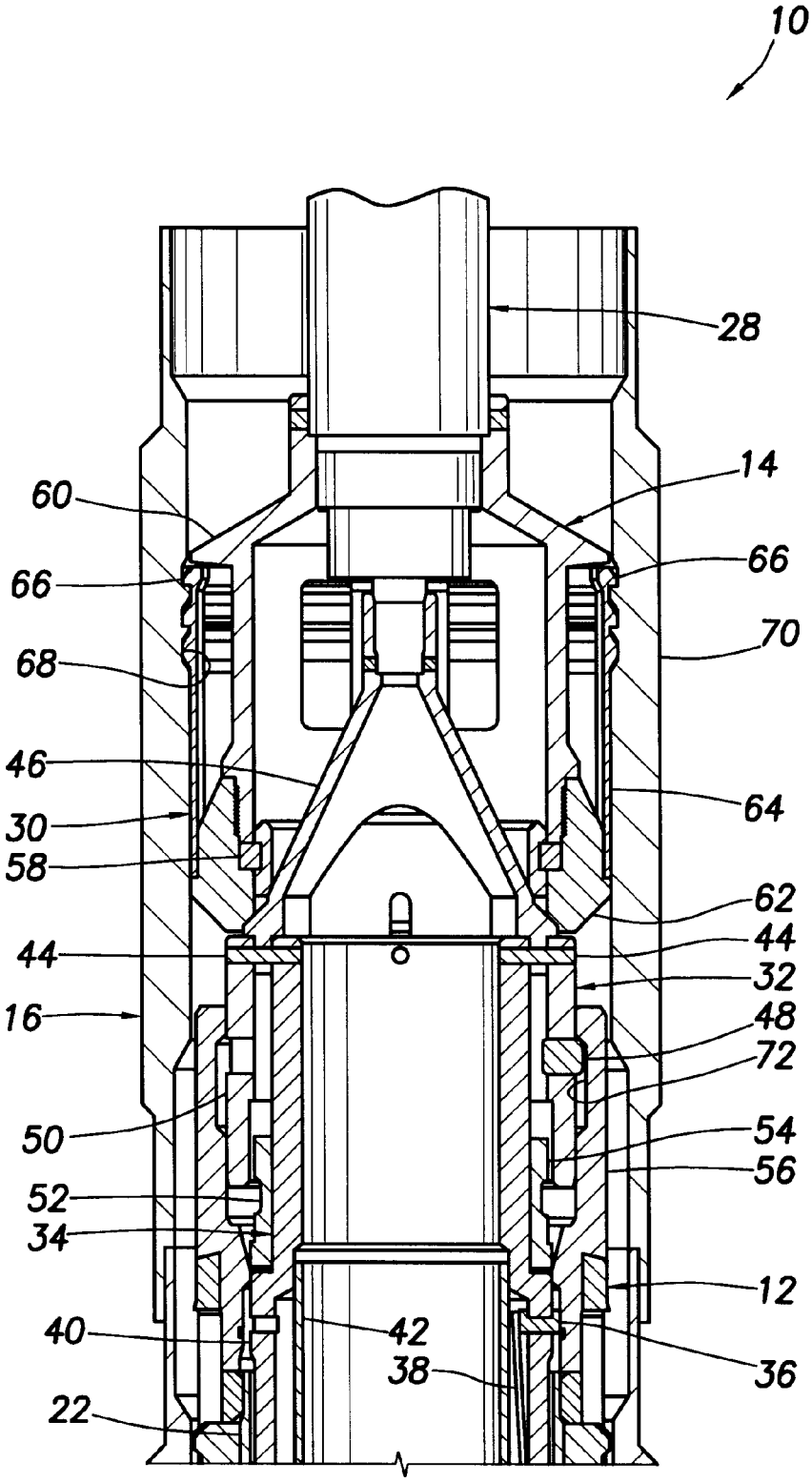
FIGS. 4A&B are cross-sectional views of the retrieval tool of FIG. 1, the tool being shown in a configuration in which it is retrieving the mandrel.
Figure 4B:
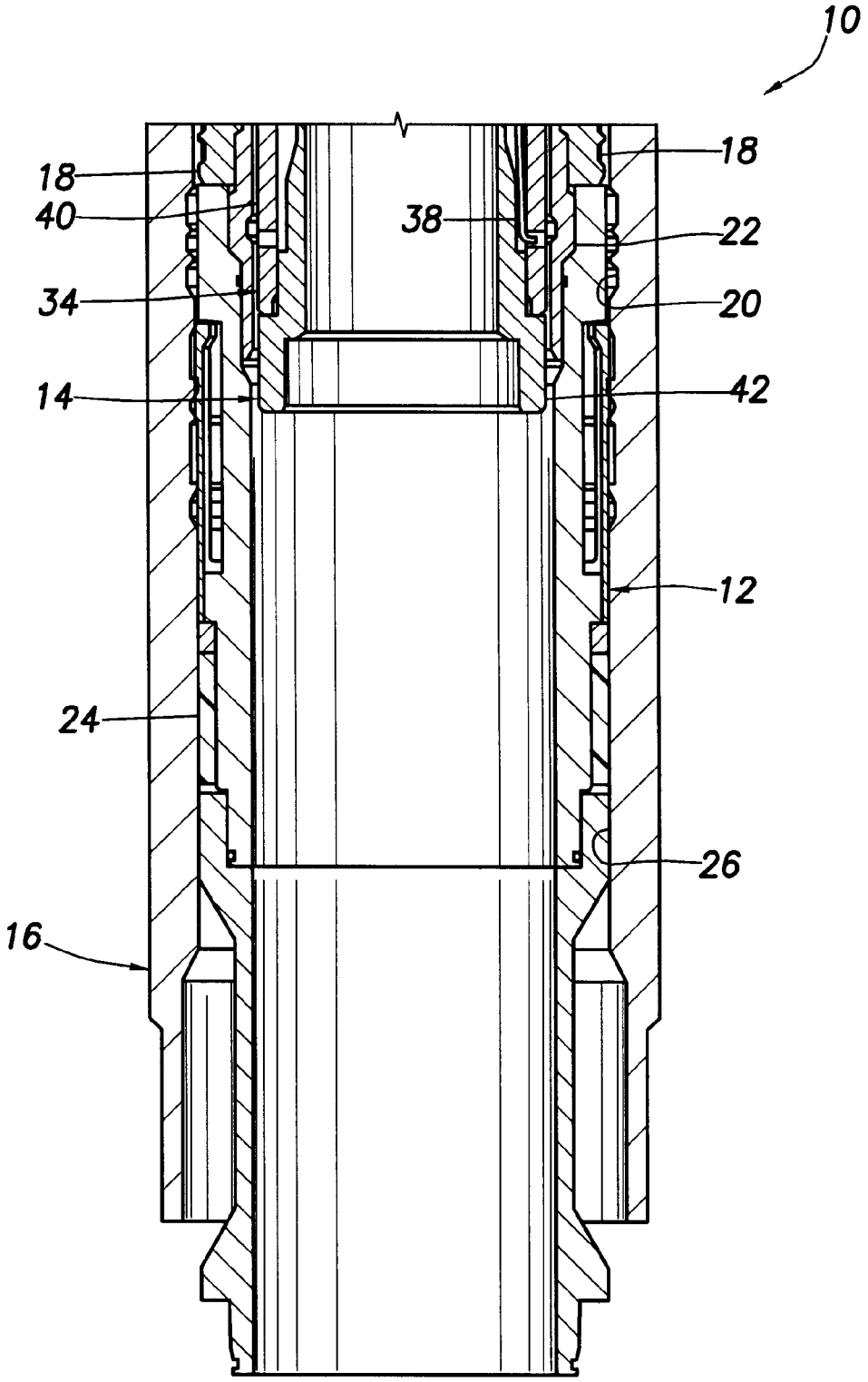

Referring additionally now to FIGS. 4A&B, the retrieval tool 14 is depicted in a configuration in which the actuator 28 has applied sufficient force to the mandrel 12 to raise it upwardly relative to the tubing string 16. The seal 24 has now been displaced relative to the seal bore 26 and, if the seal was previously adhered to the seal bore, such adhesion has been overcome by the force exerted by the actuator 28. The retrieval tool 14, the mandrel 12 and any other equipment which may be attached thereto, such as a safety valve, may now be conveyed upwardly out of the tubing string 16.

Referring additionally now to FIGS. 5–8, another embodiment of a method 80 for retrieving an item of equipment 82 from a tubular string is representatively illustrated. The method 80 is similar in many respects to the method 10 described above, and utilizes a retrieval tool 84 similar in many respects to the retrieval tool 14 described above. Accordingly, the same reference numbers are used in FIGS. 5–8 to indicate elements which are similar to elements previously described.

Figure 5:
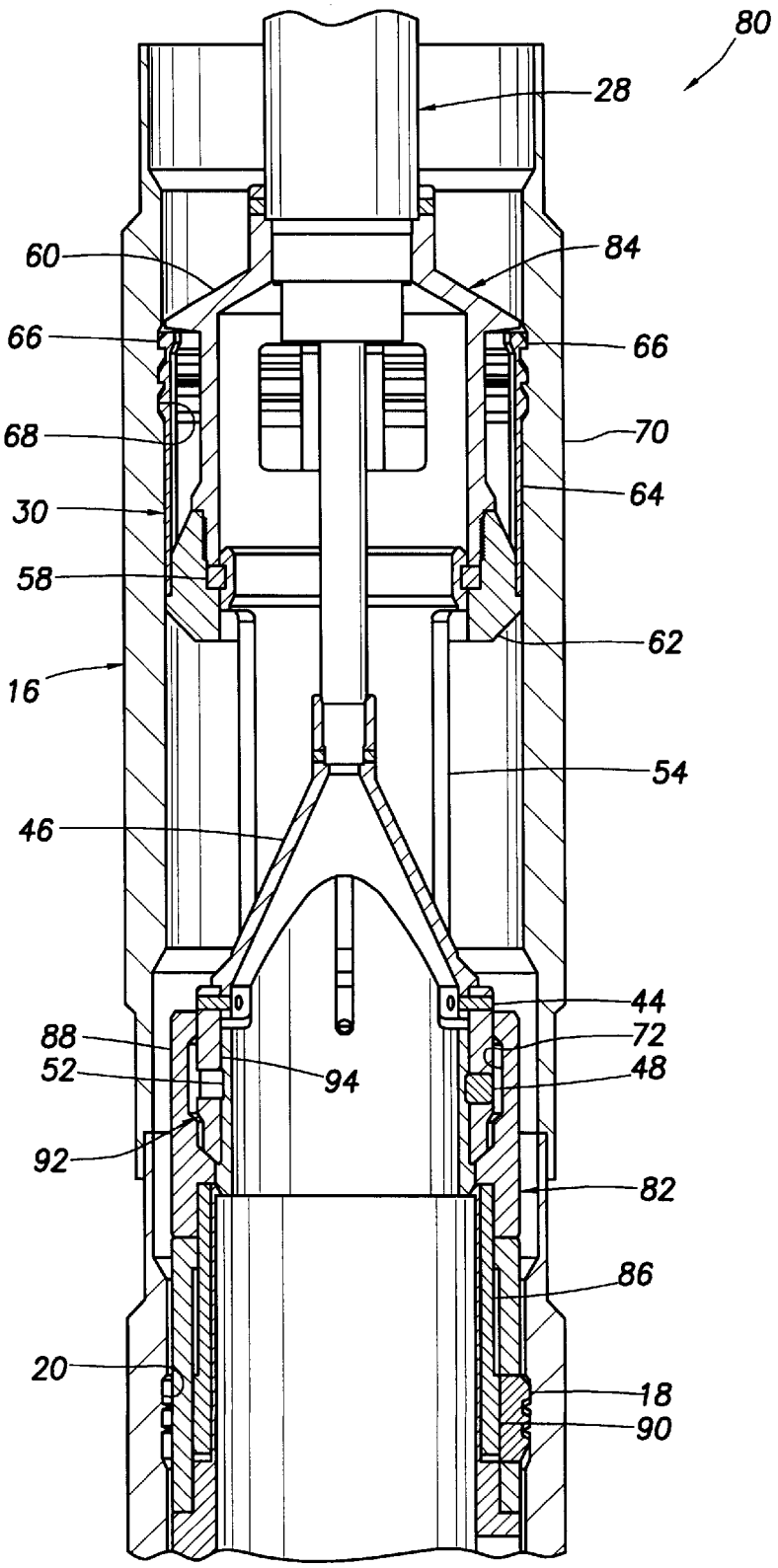
FIG. 5 is a cross-sectional view of a second retrieval tool embodying principles of the present invention, the tool being shown in a configuration in which it is conveyed into engagement with a lock mandrel for a flow control device.

The item of equipment 82 in the representatively illustrated method 80 is a lock mandrel similar to the mandrel 12 described above, but which differs in at least one significant respect. The mandrel 82 is alternately secured and released for displacement relative to the tubing string 16 by displacing a locking sleeve 86, which is attached to a fishing neck 88 of the mandrel, instead of by displacing the separate locking sleeve 22 independently of the fishing neck 56. In FIG. 5, it may be seen that a radially enlarged surface 90 formed externally on the sleeve 86 radially outwardly supports the keys 18 in engagement with the profile 20.

The retrieval tool 84 does not displace the locking sleeve 86 when the tool is inserted into the mandrel 82. Instead, the locking sleeve 86 is displaced by a latching mechanism 92 which, in turn, is displaced by the actuator 28. Thus, the latching mechanism 92 can, in this sense, be said to include a releasing device, since it operates to release the mandrel 82 from its securement to the tubing string 16.

In FIG. 5, the retrieval tool 84 is shown in a configuration in which it has been conveyed into the tubing string 16 and downwardly displaced therein until the collets 66 engage the profile 68. Further downward displacement of the retrieval tool 84 is, therefore, prevented. Note that a sleeve 94 of the latching mechanism 92 also contacts an interior surface of the fishing neck 88.

Figure 6:
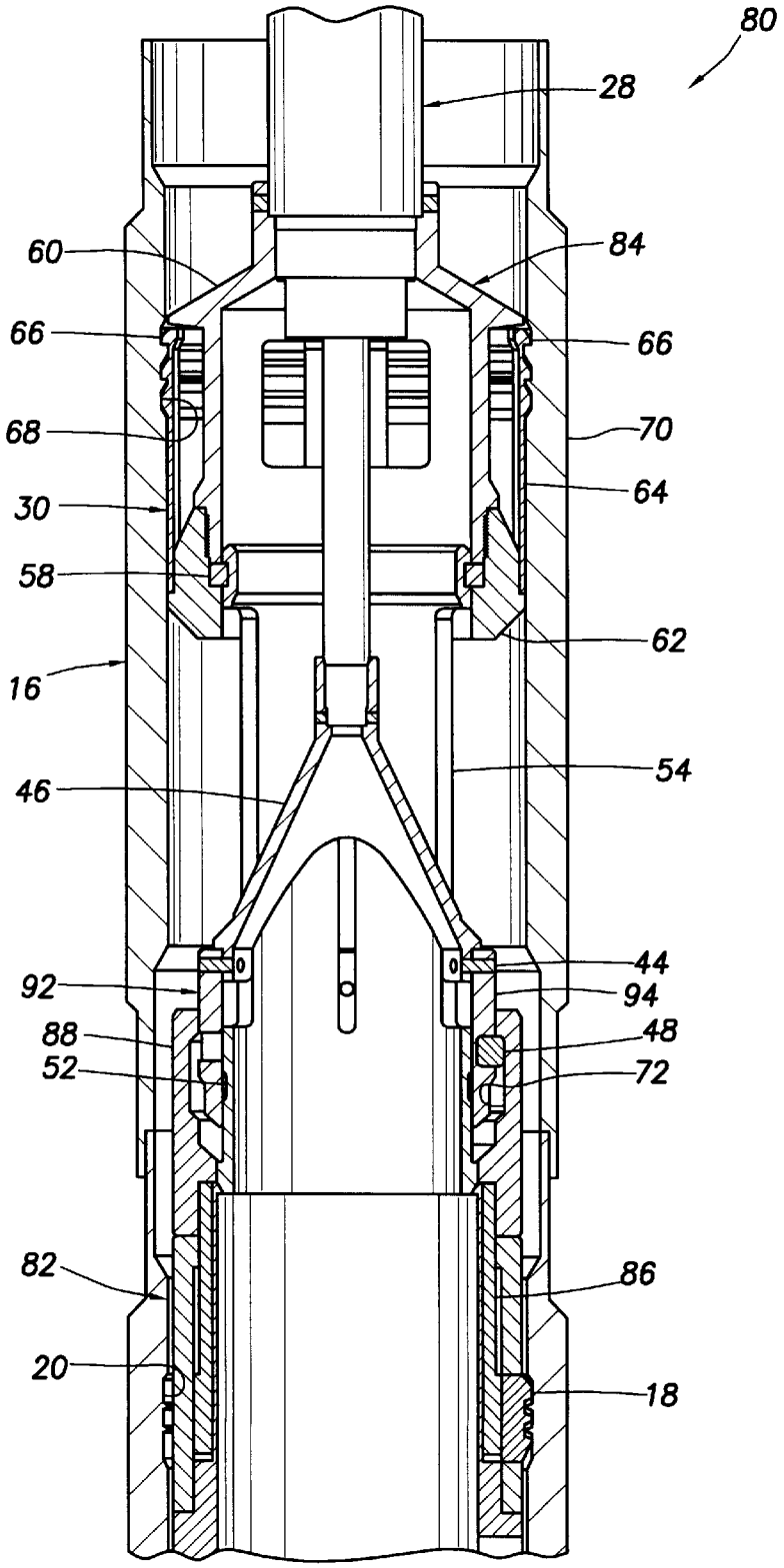
FIG. 6 is a cross-sectional view of the second retrieval tool, the tool being shown in a configuration in which lugs thereof have been engaged with the mandrel.

Referring additionally now to FIG. 6, the retrieval tool 84 is shown in a configuration in which the actuator 28 has been operated to displace the sleeve 94 and lugs 48 upwardly relative to the extension 54. In this manner, the lugs 48 are displaced radially outward out of the recess 52 and into engagement with the profile 72 in the fishing neck 88. The lugs 48 are radially outwardly supported in engagement with the profile 72 by the extension 54.

Figure 7:
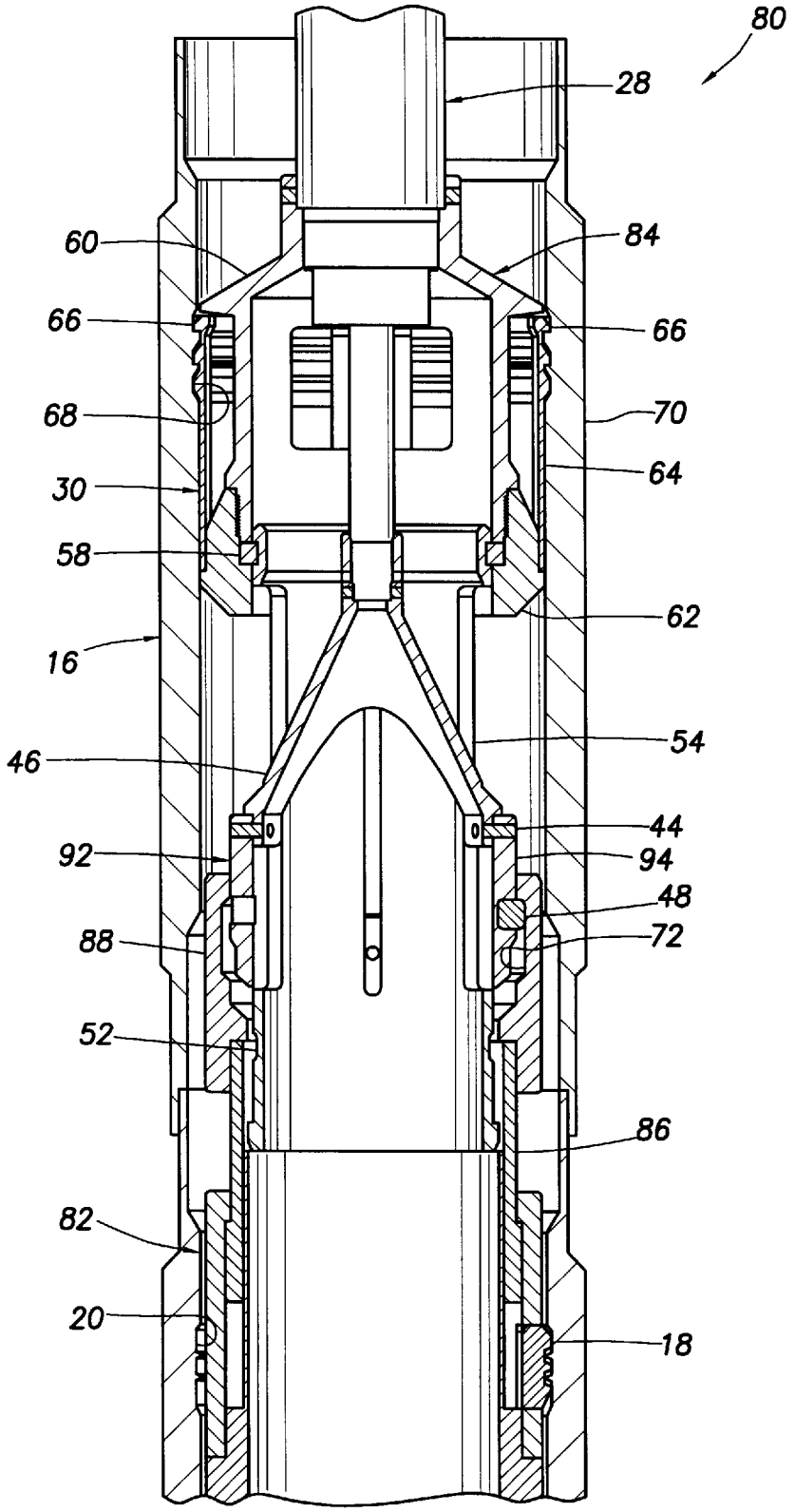
FIG. 7 is a cross-sectional view of the second retrieval tool, the tool being shown in a configuration in which the mandrel has been released for displacement relative to a tubular string.

Referring additionally now to FIG. 7, the retrieval tool 84 is shown in a configuration in which the actuator 28 has been operated to displace the sleeve 94, lugs 48, fishing neck 88 and locking sleeve 86 upwardly, the lugs remaining engaged in the profile 72. At this point, the keys 18 are no longer radially outwardly supported by the sleeve 86 and the mandrel 82 is released for displacement relative to the tubing string 16. Note that, although it appears in FIG. 7 that the lugs 48 are no longer radially outwardly supported by the extension 54, the visible lug 48 is shown rotated out of its actual position and, in actual practice, the lugs remain supported by the extension when the retrieval tool 84 is in this configuration.

Figure 8:
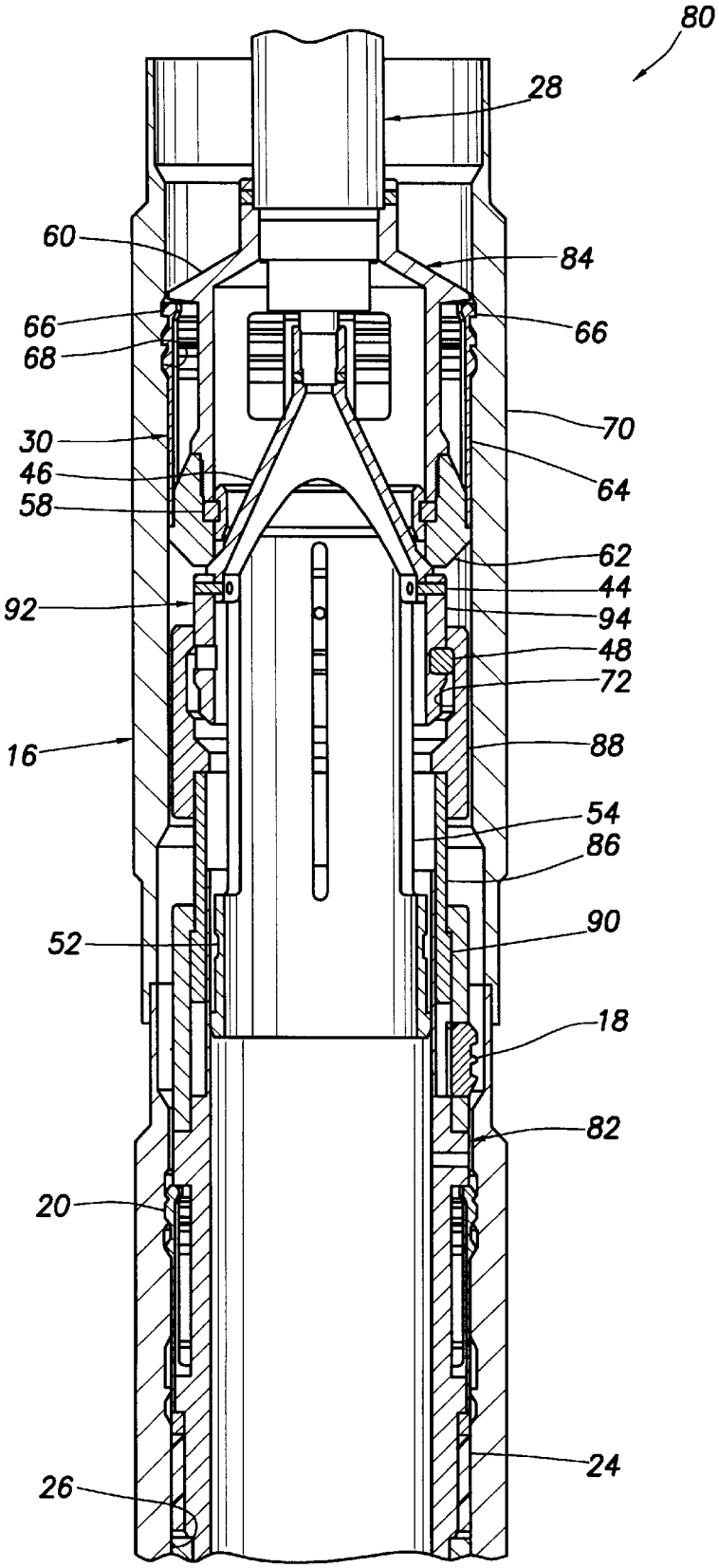
FIG. 8 is a cross-sectional view of the second retrieval tool, the tool being shown in a configuration in which it is retrieving the mandrel.

Referring additionally now to FIG. 8, the retrieval tool 84 is depicted in a configuration in which the actuator 28 has applied sufficient force to the mandrel 82 to raise it upwardly relative to the tubing string 16. The seal 24 has now been displaced relative to the seal bore 26 and, if the seal was previously adhered to the seal bore, such adhesion has been overcome by the force exerted by the actuator 28. The retrieval tool 84, the mandrel 82 and any other equipment which may be attached thereto, such as a safety valve, may now be conveyed upwardly out of the tubing string 16.

If, after the retrieval tool 14 or 84 has been engaged with the mandrel 12 or 82, and the actuator 28 applies force to the mandrel to displace it relative to the tubing string 16, but the mandrel remains stuck in the tubing string, the actuator will eventually apply a sufficiently large force to shear the shear members 44. In this manner, the actuator 28 and anchoring device 30 may then be retrieved from the tubing string 16. If the actuator 28 should malfunction, for example, so that it cannot apply a sufficient force to displace the mandrel 12 or 82, or shear the shear members 44, and if the retrieval tool 14 or 84 cannot be disengaged from the mandrel, the shear members 44 may then be sheared by applying an upwardly directed force to the actuator 28.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A tool for retrieving an item of equipment from within a tubular string disposed within a subterranean well, the tool comprising:

an actuator;

an anchoring device configured for releasably securing the actuator within the tubular string; and a latching mechanism engageable downhole with the item of equipment, whereby the actuator applies a force to the item of equipment via the latching mechanism to retrieve the item of equipment from the tubular string, the force being resisted by the anchoring device, when the retrieval tool is engaged with the item of equipment downhole, wherein the actuator displaces at least a portion of the latching mechanism relative to the anchoring device, and wherein the portion of the latching mechanism displaced by the actuator latchingly engages the item of equipment in response to the displacement of the latching mechanism portion by the actuator.

2. A tool for retrieving an item of equipment from within a tubular string disposed within a subterranean well, the tool comprising:

an actuator;

an anchoring device configured for releasably securing the actuator within the tubular string; and a latching mechanism engageable downhole with the item of equipment, whereby the actuator applies a force to the item of equipment via the latching mechanism to retrieve the item of equipment from the tubular string, the force being resisted by the anchoring device, when the retrieval tool is engaged with the item of equipment downhole, and wherein the actuator and anchoring device are releasably secured to the latching mechanism.

3. The retrieval tool according to claim 2, wherein a shear member releasably secures the actuator and anchoring device to the latching mechanism.

4. A tool for retrieving an item of equipment from within a tubular string disposed within a subterranean well, the tool comprising:

an actuator;

an anchoring device configured for releasably securing the actuator within the tubular string; and a latching mechanism engageable downhole with the item of equipment, whereby the actuator applies a force to the item of equipment via the latching mechanism to retrieve the item of equipment from the tubular string, the force being resisted by the anchoring device, when the retrieval tool is engaged with the item of equipment downhole, and wherein an engagement member of the latching mechanism is outwardly extended into latching engagement with an internal profile of the item of equipment in response to displacement of a portion of the latching mechanism by the actuator.

5. A tool for retrieving an item of equipment releasably secured within a tubular string disposed within a subterranean well, the tool comprising:

a latching mechanism configured for latching engagement with the item of equipment;

a releasing device configured for releasing the item of equipment from securement to the tubular string; and an anchoring device configured for releasably securing the latching mechanism and releasing device relative to the item of equipment.

6. The retrieval tool according to claim 5, wherein the releasing device displaces a portion of the item of equipment maintaining the item of equipment secured relative to the tubular string in response to insertion of the retrieval tool into the item of equipment.

7. The retrieval tool according to claim 5, wherein the releasing device includes an outwardly extending release member, the release member engaging and causing displacement of a portion of the item of equipment, thereby releasing the item of equipment from securement relative to the tubular string, when the retrieval tool is received in the item of equipment.

8. The retrieval tool according to claim 5, wherein the releasing device is included in the latching mechanism, the item of equipment being released from securement to the tubular string when the latching mechanism is latchingly engaged with a portion of the item of equipment maintaining the item of equipment secured relative to the tubular string and the latching mechanism is displaced relative to the anchoring device.

9. The retrieval tool according to claim 5, further comprising an actuator attached to the anchoring device.

10. The retrieval tool according to claim 9, wherein the actuator displaces at least a portion of the latching mechanism relative to the anchoring device.

11. The retrieval tool according to claim 10, wherein the latching mechanism latchingly engages the item of equipment when the retrieval tool is operatively received in the item of equipment and the latching mechanism portion is displaced relative to the anchoring device.

12. A method of retrieving an item of equipment from within a tubular string in which the item of equipment is releasably secured, the method comprising the steps of:

conveying a retrieval tool into the tubular string;

anchoring the retrieval tool within the tubular string using an anchoring device of the retrieval tool, by engaging a collet of the anchoring device with an internal profile formed in a nipple interconnected in the tubular string;

latching the retrieval tool to the item of equipment using a latching mechanism of the retrieval tool; and displacing at least a portion of the latching mechanism relative to the anchoring device.

13. A method of retrieving an item of equipment from within a tubular string in which the item of equipment is releasably secured, the method comprising the steps of:

conveying a retrieval tool into the tubular string;

anchoring the retrieval tool within the tubular string using an anchoring device of the retrieval tool;

latching the retrieval tool to the item of equipment using a latching mechanism of the retrieval tool; and displacing at least a portion of the latching mechanism relative to the anchoring device, and wherein the latching step is performed in response to the displacement of at least the portion of the latching mechanism relative to the anchoring device.

14. A method of retrieving an item of equipment from within a tubular string in which the item of equipment is releasably secured, the method comprising the steps of:

conveying a retrieval tool into the tubular string;

anchoring the retrieval tool within the tubular string using an anchoring device of the retrieval tool;

latching the retrieval tool to the item of equipment using a latching mechanism of the retrieval tool;

displacing at least a portion of the latching mechanism relative to the anchoring device; and displacing a member of the item of equipment maintaining the item of equipment secured relative to the tubular string.

15. The method according to claim 14, wherein the member displacing step is performed in response to insertion of the retrieval tool into the item of equipment.

16. The method according to claim 14, wherein the member displacing step is performed in response to the latching mechanism portion displacing step.

17. The method according to claim 14, wherein the member is attached to a portion of the item of equipment latchingly engaged by the latching mechanism, and wherein the member and the item of equipment portion are displaced with the latching mechanism portion in the latching mechanism portion displacing step.

18. A method of retrieving an item of equipment from within a tubular string in which the item of equipment is releasably secured, the method comprising the steps of:

conveying a retrieval tool into the tubular string;

anchoring the retrieval tool within the tubular string using an anchoring device of the retrieval tool;

latching the retrieval tool to the item of equipment using a latching mechanism of the retrieval tool; and displacing at least a portion of the latching mechanism relative to the anchoring device, thereby removing a seal of the item of equipment from a seal bore of the tubular string.

* * * * *